US006062553A

United States Patent [19]

Strehl

[11] Patent Number: 6,062,553

[45] Date of Patent: May 16, 2000

[54] VICE JAW ASSEMBLY WITH FLOATING SPACER AND GRIPPING BLOCKS FOR USE WITH A TOOL HOLDER

[76] Inventor: Edward A. Strehl, 51108 Milano, Macomb, Mich. 48042

[21] Appl. No.: 09/350,453

[22] Filed: Jul. 9, 1999

[51] Int. Cl.[7] ..... B25B 1/02

[52] U.S. Cl. ..... 269/43; 269/282; 269/153; 269/154; 269/268; 269/244; 269/906

[58] Field of Search ..... 269/43, 277, 282, 269/283, 152, 153, 154, 244, 268, 906

[56] References Cited

U.S. PATENT DOCUMENTS

| | | | |
|---|---|---|---|
| 4,098,500 | 7/1978 | Lenz . | |
| 4,241,906 | 12/1980 | Cole | 269/43 |
| 4,437,654 | 3/1984 | Chiappetti . | |
| 4,602,772 | 7/1986 | Wight et al. . | |
| 4,685,663 | 8/1987 | Jorgensen . | |
| 4,706,949 | 11/1987 | Dossey et al. . | |
| 4,750,722 | 6/1988 | Chick . | |
| 4,824,084 | 4/1989 | Tzong-Lin . | |
| 4,852,866 | 8/1989 | Kristoff | 269/277 |
| 4,861,010 | 8/1989 | Neil . | |
| 4,923,186 | 5/1990 | Durfee, Jr. . | |
| 4,928,937 | 5/1990 | Bernstein . | |
| 4,960,270 | 10/1990 | Fitzpatrick . | |
| 5,024,427 | 6/1991 | Swann . | |
| 5,037,075 | 8/1991 | Durfee, Jr. . | |
| 5,060,920 | 10/1991 | Engibarov . | |
| 5,065,990 | 11/1991 | Durfee . | |
| 5,078,372 | 1/1992 | Fitzpatrick . | |
| 5,098,073 | 3/1992 | Lenz . | |
| 5,129,638 | 7/1992 | Durfee, Jr. . | |
| 5,141,213 | 8/1992 | Chern . | |
| 5,193,732 | 3/1993 | Interrante et al. . | |
| 5,222,997 | 6/1993 | Montgomery | 269/277 |
| 5,330,167 | 7/1994 | Plumb | 269/43 |
| 5,335,898 | 8/1994 | Johnson . | |
| 5,425,532 | 6/1995 | Wolfe . | |
| 5,458,321 | 10/1995 | Durfee, Jr. . | |
| 5,505,437 | 4/1996 | Durfee, Jr. . | |
| 5,535,995 | 7/1996 | Swann et al. . | |
| 5,595,375 | 1/1997 | Bannhausen . | |
| 5,623,757 | 4/1997 | Durfee, Jr. . | |
| 5,634,253 | 6/1997 | Swann . | |
| 5,649,694 | 7/1997 | Buck . | |
| 5,702,096 | 12/1997 | Buck . | |
| 5,720,476 | 2/1998 | Swann et al. . | |
| 5,762,326 | 6/1998 | Swann . | |

*Primary Examiner*—Robert C. Watson

*Attorney, Agent, or Firm*—Gifford, Krass, Groh, Sprinkle, Anderson & Citkowski, P.C.

[57] ABSTRACT

A vice jaw assembly mounted upon a precision machining piece of equipment, the equipment including a platform accessible by a machining tool. The vice assembly includes a base which is fixedly secured upon the platform and first and second spaced apart jaw members which are in turn mounted upon the base. A crank mechanism is employed for actuating at least one of the jaw members in directions towards and away from each other. First and second spacer blocks are secured to the first and second jaw members, respectively, by mounting bolts which extend through aligned apertures between the spacer blocks and jaw members. A mounting pin secures to the first spacer block and extends through an aperture in the second spaced apart spacer block. Additional intermediate and floating spacer blocks are arrayed at predetermined locations between the first and second spacer blocks and each includes an additional aperture formed therethrough which receives in inserting fashion the mounting pin. Workpiece engaging surfaces are formed along opposing top edge surfaces of the first and second spacer blocks which are secured to the first and second jaw members, as well as along parallel extending and opposite top edge surfaces of the additional intermediate and floating spacer blocks. The workpiece engaging surfaces function so as to secure against opposing engaging surfaces of each individual workpiece and to permit a plurality of such workpieces to be mounted at selected locations upon the vice jaw assembly during a continuous machining operation.

11 Claims, 5 Drawing Sheets

VICE JAW ASSEMBLY WITH FLOATING SPACER AND GRIPPING BLOCKS FOR USE WITH A TOOL HOLDER

BACKGROUND OF THE INVENTION

1. Field of the Invention

The present invention relates generally to vice assemblies with at least first and second opposingly facing jaws, one of which being movable for selectively loosening and tightening the vice assembly to secure a workpiece therebetween. More specifically, the present invention discloses a vice jaw assembly with first and second anchored jaw portions and with at least one additional floating jaw mounted in translatable fashion between the first and second anchored jaw portions.

2. Description of the Prior Art

The prior art is replete with various types of vice and jaw assemblies, particularly in use with a pallet or base support within an item of tool machining equipment. Most commonly, such vice assemblies of this nature are utilized for holding in a fixed and secure manner a workpiece which is subject to a machining action of such a tool. The machining operation is also preferably a computer numerically controlled (CNC) operation which guides a drilling, cutting, boring, deburring or other conventional machining tool.

A first example of a prior art vice assembly is illustrated in U.S. Pat. No. 4,685,663, issued to Jorgensen, which teaches a precision vise with independently movable jaws. A dual vise includes first and second vise assemblies, each with centrally fixed stationary jaws and independently controlled moveable jaws. Each vise assembly is capable of holding a workpiece under a pressure independently of the holding pressure of the other vise assembly. The moveable jaws are controlled by concentric lead screw shafts and, when used in conjunction with a CNC operator, teaches increased productivity with commensurate decrease of damage to individual workpieces.

U.S. Pat. No. 5,702,096, issued to Buck, teaches a pallet with multiple vises which are disposed in sidewardly spaced but generally parallel relation and which include jaws associated with the vise activated by an elongate actuator screw which extends longitudinally of a groove in the pallet. A still further basic example of the prior art is illustrated in U.S. Pat. No. 5,458,321, issued to Durfee, Jr., and which discloses a two station machining vise with removable and off-settable jaws. The Durfee, Jr. assembly includes two movable outer positioned jaws and a fixed center jaw. The movable jaws are removable and resettable onto associated slides and the slides include upperly projecting bodies with pressure release latches for fixing the jaws in position on the slides.

SUMMARY OF THE PRESENT INVENTION

The present invention is a vice jaw assembly having any desired plurality of floating and intermediate spacer blocks which are arrayed between first and second secured and actuable outer spacer blocks and which enables fast and effective setup of the vice assembly so as to hold a plurality of individual workpiece items subject to continuous machining operation from a machine tool, and preferably a CNC machining operation.

The vice jaw assembly is mounted upon the precision machining piece of equipment, the equipment typically including a platform accessible by a machining tool. The vice assembly includes a substantially rectangular shaped and three dimensional base which is fixedly secured upon the platform. A first jaw member and a second jaw member are securing upon the three dimensional base at first and second ends thereof and so that the jaw members define opposingly arrayed faces. A hand crank is provided for actuating one of the jaw members in directions towards and away from the other jaw member.

A first spacer block is fixedly secured to the opposingly arrayed face of the first jaw member and a second spacer block fixedly secured to the opposingly arrayed face of said second jaw member. Pairs of fastener apertures are formed through each of the spacer blocks and align with further apertures defined within the first and second jaw members. Each of the apertures in the spacer blocks further includes a first diameter portion extending from a first selected face of the associated spacer block in contact with the selected jaw member and to an intermediate location. A contiguous second enlarged and countersunk diameter portion extends from the intermediate location to a second face of said spacer block and permits mountable bolt fasteners with enlarged bolt heads to be inserted within the spacer block apertures to secure said spacer blocks to said jaw members in a flush manner.

In a first preferred embodiment, a single mounting pin is secured at a first end to the first spacer block and extends so as to pass through an aperture defined in the second spacer block. In a second preferred embodiment, the single mounting pin is substituted by a pair of parallel extending and spaced apart mounting pins which are received through a pair of apertures defined in aligned fashion within the second spacer block.

One or more floating spacer blocks are provided and which are capable of being freely translatably mounted within the vice assembly between the first and second spacer blocks. Each of the floating spacer blocks also includes an aperture formed therethrough and through which the mounting pin or pins extend so that the floating spacer block is arrayed at a predetermined spaced distance between the first and second spacer blocks.

Workpiece engaging surfaces are defined within the jaw member mounted spacer blocks and the intermediate and floating spacer blocks. The workpiece engaging surfaces including inwardly stepped shoulders defined along selected top edges of both the spacer and intermediate floating spacer blocks and are suitable for engaging outwardly facing edges of each individual workpiece so that the workpieces may be secured within the vice jaw assembly. The workpiece engaging surfaces may further be provided in any desired configuration consistent with the desire to hold a plurality of workpieces, such gripping surfaces potentially being arcuate or semicylindrical shaped for holding therebetween cylindrically shaped workpieces. The advantages of the floating and intermediate spacer blocks and the workpiece engaging surfaces are that they facilitate fast and easy setup of a plurality of individual workpieces, such as by sliding the floating spacer blocks manually to position the workpieces, and then by crank tightening the outer spacer blocks fixed to the first and second jaw members to anchor in place the workpieces for the desired machining operation.

BRIEF DESCRIPTION OF THE DRAWINGS

Reference will now be made to the attached drawings, when read in combination with the following specification, wherein like reference numerals refer to like parts throughout the several views, and in which.

DETAILED DESCRIPTION OF THE PREFERRED EMBODIMENTS

Figure 1:
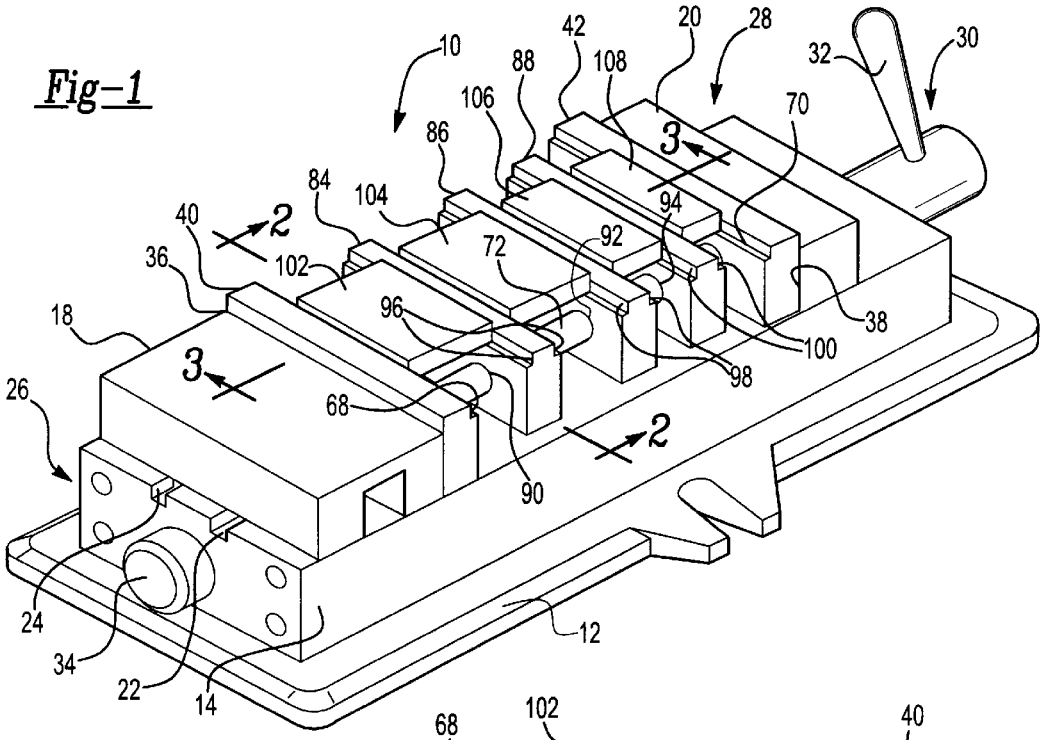
FIG. 1 is an operational view in perspective of the vice jaw assembly according to a preferred embodiment of the present invention.

Referring now to FIG. 1, a vice jaw assembly is illustrated at 10 for mounting upon a precision machining piece of equipment. The equipment is not shown for purposes of ease of illustration, however it is understood that any conventional type of drilling, boring, cutting, shearing or grinding/abrading machining process can be employed with the vice assembly 10 and it is specifically suited for use with such a computer numerically controlled (CNC) device for ensuring precise movement of the specified machining tool.

The vice jaw assembly includes a platform 12, typically forming a part of the mounting structure to the machining tool and which is substantially horizontally arrayed upon the machining tool structure. A substantially rectangular shaped and three dimensional base 14 is fixedly secured upon the platform, typically in a generally horizontally arrayed fashion and is constructed of a heavy-duty steel or carbon steel material. Mounted upon an upper surface 16 of the base 14 are a first jaw member 18 and a second jaw member 20. The jaw members 18 and 20 are each constructed as three-dimensional and generally rectangular planar faced members and are themselves secured upon the base 14. Typically, one or more longitudinally extending grooves or channels, see at 22 and 24 in FIG. 1, extend from a first end 26 of the base 14 to a location prior to the second end 28. Underside locations of at least one or both of the first and second jaw members 18 and 20 typically may also include conventional projections (not shown) suitable for engaging the jaw members to the base 14. A rotating crank mechanism 30 includes a handle 32 which may be turned and which activates a screw 34 extending longitudinally throughout the base 14. A selected one of the jaw members, such as first jaw member 18, may be operatively connected at its underside location (as is known in the art) to the screw 34 and so as to facilitate translation of the first jaw member 18 in directions both towards and away from the second jaw member 20. In this fashion, the jaw members define opposingly arrayed faces, such as face 36 for first jaw 18 and face 38 for second jaw 20 (see also FIG. 3).

Figure 2:
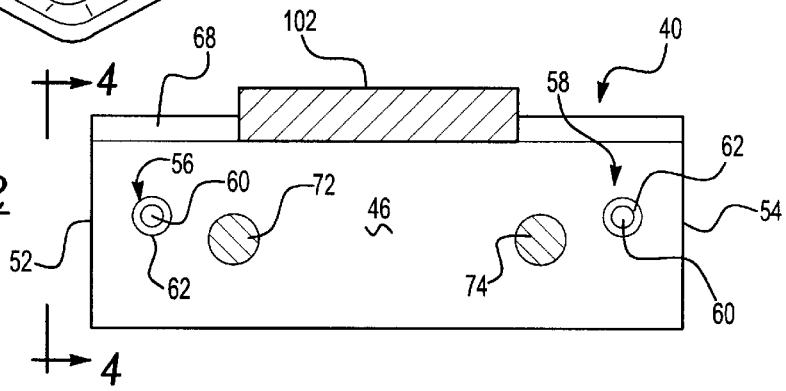
FIG. 2 is a cutaway end view along line 2—2 of FIG. 1 and further illustrating the first spacer block and the manner in which it secures to the first jaw member according to the jaw assembly of the present invention.
Figure 4:
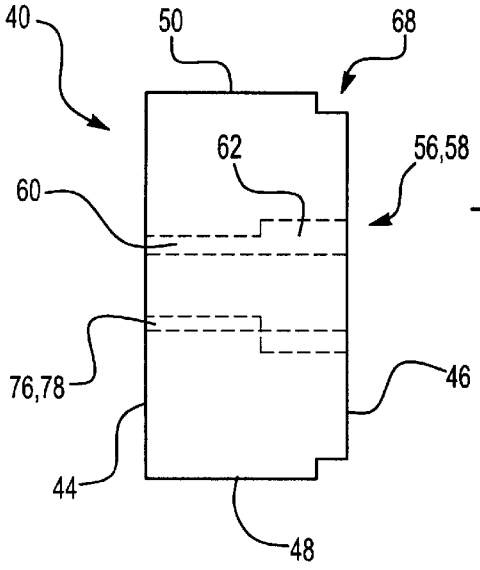
FIG. 4 is a further cutaway taken along line 4—4 of FIG. 2 and illustrating in side phantom designation the apertures in the selected spacer block for receiving the mounting pins, as well as the countersunk shaping of the fastener apertures for facilitating flush engagement of the mounting bolts.

A first spacer block 40 is provided and is fixedly secured to the opposing face 36 of the first jaw member 18. A second spacer block 42 is likewise fixedly secured to the opposing face 38 of the second jaw member 20. The first and second spacer blocks 40 and 42 are each constructed of carbon steel, or material exhibiting similar properties, and are generally three dimensionally shaped with planar side surfaces. Referring to FIGS. 2 and 4 in combination, the first spacer block 40 is again illustrated and includes a first surface 44 which abuts the opposingly planar surface 36 of the first jaw 18, a second oppositely facing surface 46, a bottom surface 48, a top surface 50, a first side edge surface 52 (see FIG. 2) and a second side edge surface 54.

Referring again to FIGS. 2 and 4, a pair of fastener apertures 56 and 58 are formed in substantially horizontally extending fashion through the first spacer block 40 and aligning with further apertures (not shown) defined within the associated first jaw member 18. Each of the apertures 56 and 58 in the spacer block 40 further include a first diameter portion 60 extending from the first selected face 44 of the spacer block 40 in contact with the selected jaw member 18 and to an intermediate location. A contiguous and second enlarged and countersunk diameter portion 62 extends from the intermediate location to the second opposite face 46. Bolt fasteners 64 and 66 (see in phantom in side cutaway view of FIG. 3) with enlarged bolt heads are inserted within apertures 56 and 58, through the countersunk portions 62, and engage appropriately configured and interiorly threaded portions formed along the first diameter portions 60, as well as the corresponding and aligned apertures formed within the jaw member 18, to secure the first spacer block 40 to the first jaw member 18.

A detailed description of the first spacer block 40 is provided herein and it is understood that the second spacer block 42 is largely identical in its construction and manner of affixation to the second jaw member 20 such that a repeated description is unnecessary. Referring again to FIGS. 2 and 4, a workpiece engaging surface 68 is defined by inwardly stepped shoulders formed within top edge surfaces of the spacer block 40 and in the vicinity of the intersection of the oppositely (and inwardly) facing side 46 and the top surface 50. An identical engaging surface 70 is also provided for the second spacer block 42.

Figure 3:
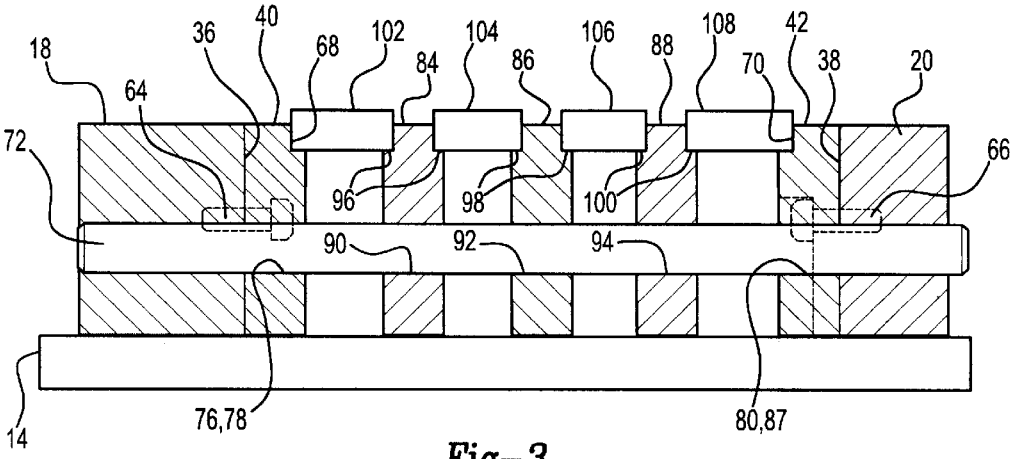
FIG. 3 is a further longitudinal cutaway view taken along line 3—3 of FIG. 1 and illustrating the floating and translational nature of the intermediate spacer blocks and their ability to facilitate support and securement of a plurality of individual workpieces at specified locations between the first and second secured spacer blocks at opposite ends.

According to the first preferred embodiment, a pair of first and second mounting pins 72 and 74 are secured at a first end to first spacer block 40 (preferably through holes 76 and 78 formed in the first block 40 and as evident in the cutaway of FIG. 3 and side profile of FIG. 4) and extend in a longitudinal direction so as to pass through additional apertures 80 and 87 defined in the second spacer block 42. As is viewed in FIG. 3, the mounting pins 72 and 74 are shown extending beyond the spacer blocks 40 and 42 and also through the first and second jaw members 18 and 20 and such is also contemplated by the present invention.

Referring again to FIGS. 1 and 3, intermediate and floating spacer blocks are provided for positioned in spatially arrayed fashion between the first spacer block 40 and the second spacer block 42. Specifically, illustrated in FIGS. 1 and 3 are first 84, second 86 and third 88 intermediate and floating spacer blocks. Each of the spacer blocks are constructed according to similar shape and material content as the spacer blocks 40 and 42 previously described and each further includes apertures formed therethrough and through which the mounting pins 72 and 74 extend so that the floating spacer blocks 84, 86 and 88 are arrayed at predetermined spaced distances between the first 40 and second 42 spacer blocks which are mounted to the first 18 and second 20 jaw members. Specifically, and referring to the first pin 72 which is the only one visible in the views of FIGS. 1 and 3, apertures 90, 92 and 94 are provided through the floating spacer blocks 84, 86 and 88, respectively, to permit insertion therethrough of the pin 72, it being clearly understood that identically configured and aligned apertures are also provided for the second pin 74 but are hidden from view.

Additional workpiece engaging surfaces, identical to those illustrated at 68 and 70 for the first and second spacer blocks 40 and 42 respectively, are also provided for the intermediate and floating spacer blocks 84, 86 and 88. Pairs of the identically configured engaging surfaces are illustrated at 96, 98 and 100 for the spacer blocks 84, 86, and 88, respectively, and, according to the preferred embodiment, are arrayed along opposite and top edge surfaces of each of the spacer blocks. As will be further explained with reference to succeeding embodiments, the workpiece engaging surfaces formed within the first and second jaw members and the various floating spacer blocks may also be provided in any other configuration without departing from the scope of the present invention.

Upon mounting the floating spacer blocks 84, 86 and 88 upon the vice assembly 10, and in freely translatable/sliding fashion along the mounting pins 73 and 74 between the first and second spacer blocks 40 and 42, a plurality of individual workpieces are positioned upon the opposing workpiece engaging surfaces established between the book-end defining spacer blocks 40 and 42 and the intermediate floating spacer blocks 84, 86 and 88. Specifically, individual workpieces 102, 104, 106 and 108 each include outwardly facing edges which abut upon the inwardly stepped shoulders of the various workpiece engaging surfaces 68 and 70 for spacer blocks 40 and 42 respectively and similar pairs engaging surfaces 96, 98 and 100 for floating spacer blocks 84, 86 and 88, respectively. Accordingly, and in the tightened position, it is the workpieces themselves which support the established distances between the otherwise freely floating spacer blocks 84, 86 and 88 and the first and second jaw member mounted spacer blocks 40 and 42.

A key feature of the instant invention is the ability to establish a desired spatial distance between the first and second spacer blocks 40 and 42, such as by adjusting the crank mechanism 30, and then to quickly and manually translate each of the floating spacer blocks 84, 86 and 88 along the channeling pin members 72 and 74 so that the desired spatial positions are achieved for setting thereupon the individual workpieces 102, 104, 106 and 108. At this point, the crank mechanism 30 is actuated to tighten the vice assembly and to lock in place the workpieces for the continuous machining operation.

Figure 6:
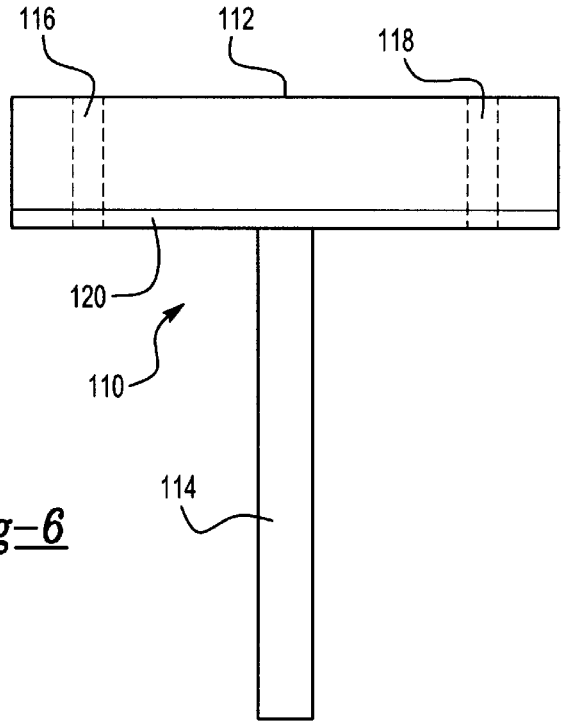
FIG. 6 is a top view of the spacer block illustrated in FIG. 5 and illustrating the single mounting pin as well as a variation in the shaping of the fastener apertures according to the present invention.
Figure 5:
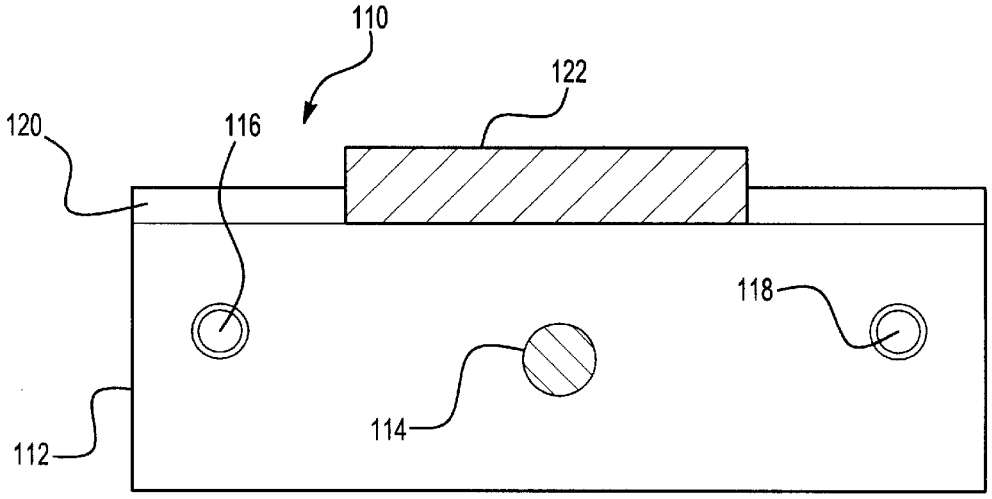
FIG. 5 is a front view of a mounting spacer block according to a further preferred embodiment of the present invention and illustrating only a single mounting pin and aperture.

Referring to FIGS. 5 and 6, an alternative variant 110 is illustrated of a spacer block 112 secured to a jaw member. The spacer block 112 would typically secure to the first jaw member 18 as disclosed in the first preferred embodiment and differs in that it mounts, at a generally centralized location, a single longitudinally extending pin 114, as opposed to the two parallel and extending pins 72 and 74 of the first embodiment. A second spacer block (fixed to the second jaw member 20) and intermediate spacer blocks would be provided which are similarly constructed with only a single central aperture substituting the two spaced and aligning apertures of the first preferred embodiment and such that a repeated disclosure is unnecessary. The spacer block 112 is also unique in that another type of fastener aperture, in this case continuous diameter portions 116 and 118, may be used for being engaged by appropriate mounting fasteners to mount the spacer block to the associated jaw member. Also, workpiece gripping surfaces, such as shown at 120 are provided identical to those disclosed in the first embodiment and facilitate gripping the edges of a workpiece 122.

Figure 7:
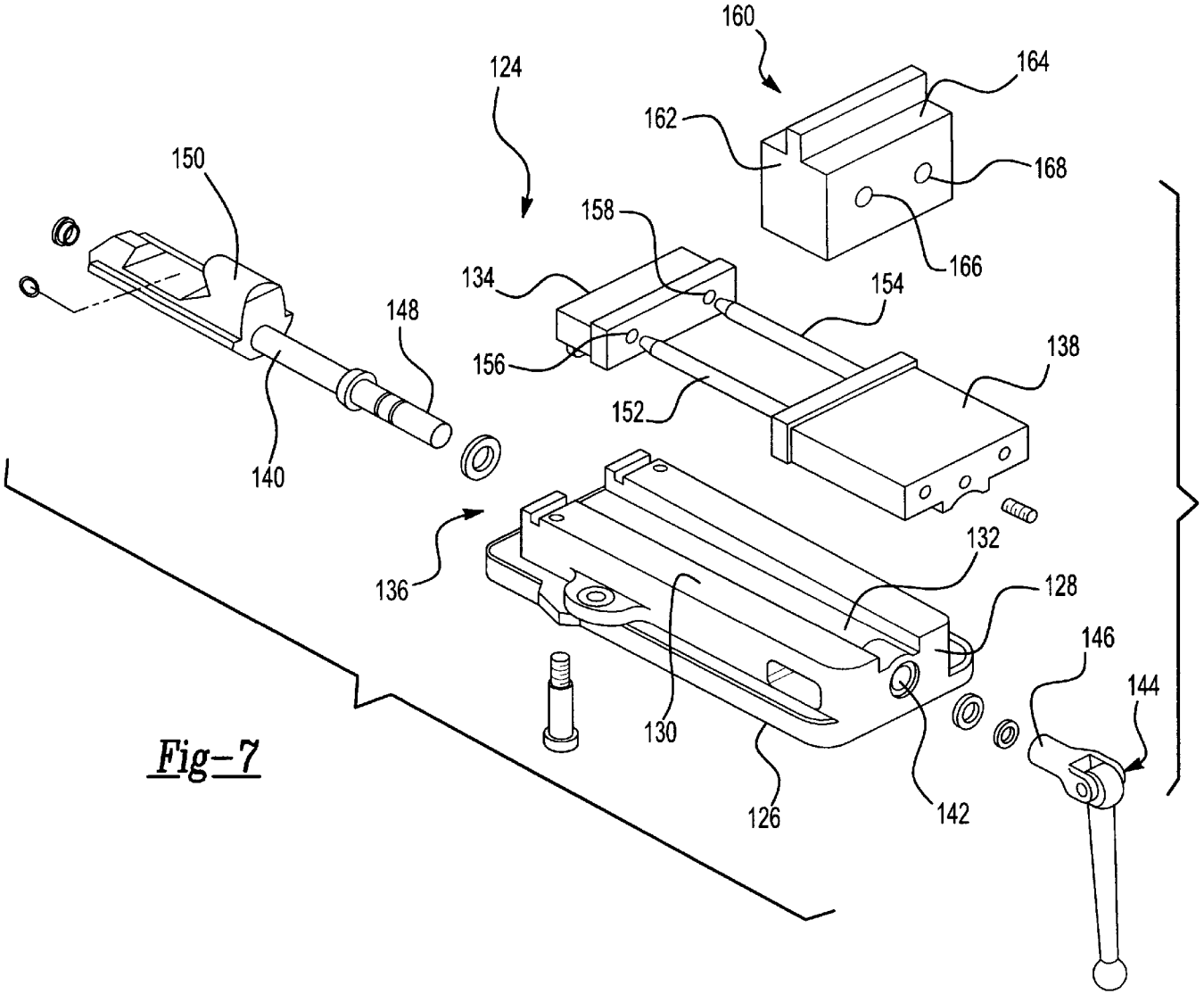
FIG. 7 is a perspective view of a vice jaw assembly according to a further preferred embodiment.

Referring to FIG. 7, a perspective view is shown at 124 of a further variation of the vice jaw assembly according to the present invention and includes a vice jaw platform 126 upon which is mounted a planar shaped base 128. A top surface 130 of the base 128 is typically channeled in an axial direction, at 132. A first jaw member 134 is mounted in a fixed manner upon a first selected end 136 of the platform 126 and a second jaw member 138 is likewise mounted in an axially translatable manner to a second selected end 140.

A crank mechanism for advancing the second jaw member 138 in directions towards and away from the first fixed jaw member 136 includes an elongate shaft portion 140 which seats within an aperture 142 extending likewise axially within the platform beneath the top surface 130. Inserted in the aperture 142 from an opposite end is a rotatable handle 144. A reception socket 146 of the handle 144 is engaged by a forward most tip 148 of the elongate shaft portion such that, upon assembly, an upwardly projecting portion 150 of the elongate shaft 140 engages a correspondingly recessed shaped underside of the second jaw member 138 and translates the jaw member 138 upon rotation of the handle 144.

First and second mounting pins 152 and 154 extend from the second jaw member 138 and is received through apertures 156 and 158 formed in the first jaw member 134. A floating spacer block is shown at 160 and is constructed substantially as with the earlier described embodiments, including workpiece engaging surfaces 162 and 164, as well as apertures 166 and 168 extending therethrough which permits the spacer block to be mounted through the pins 152 and 154.

Figure 8:
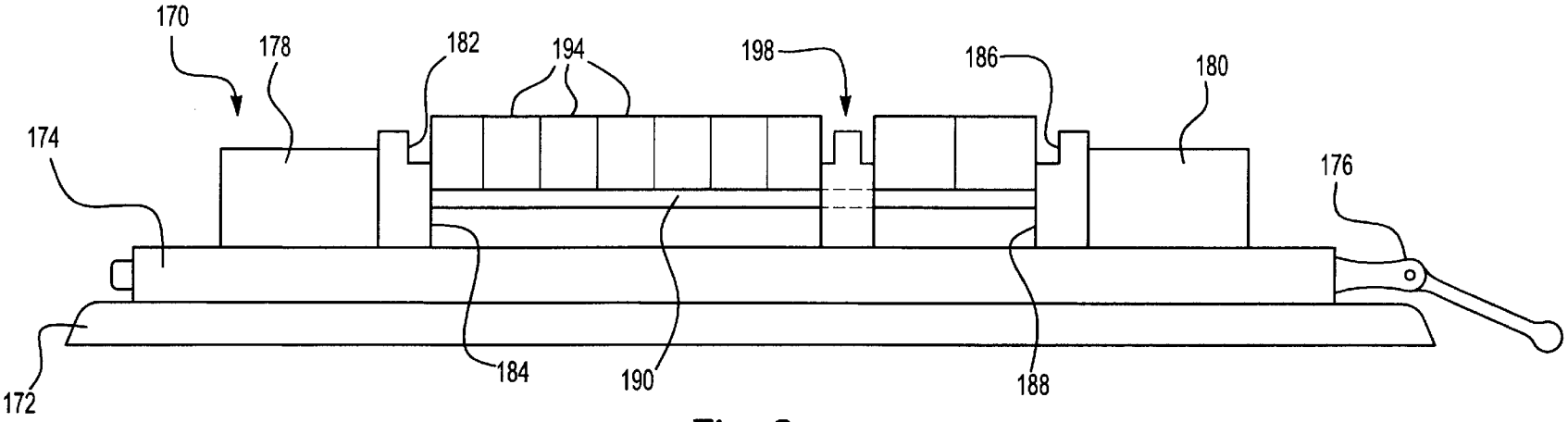
FIG. 8 is a side view of a yet further variation of a vice jaw assembly and in which a number of floating spacer blocks may be supported upon a pair of pins and fixedly retained between the first and second jaw members.
Figure 9:
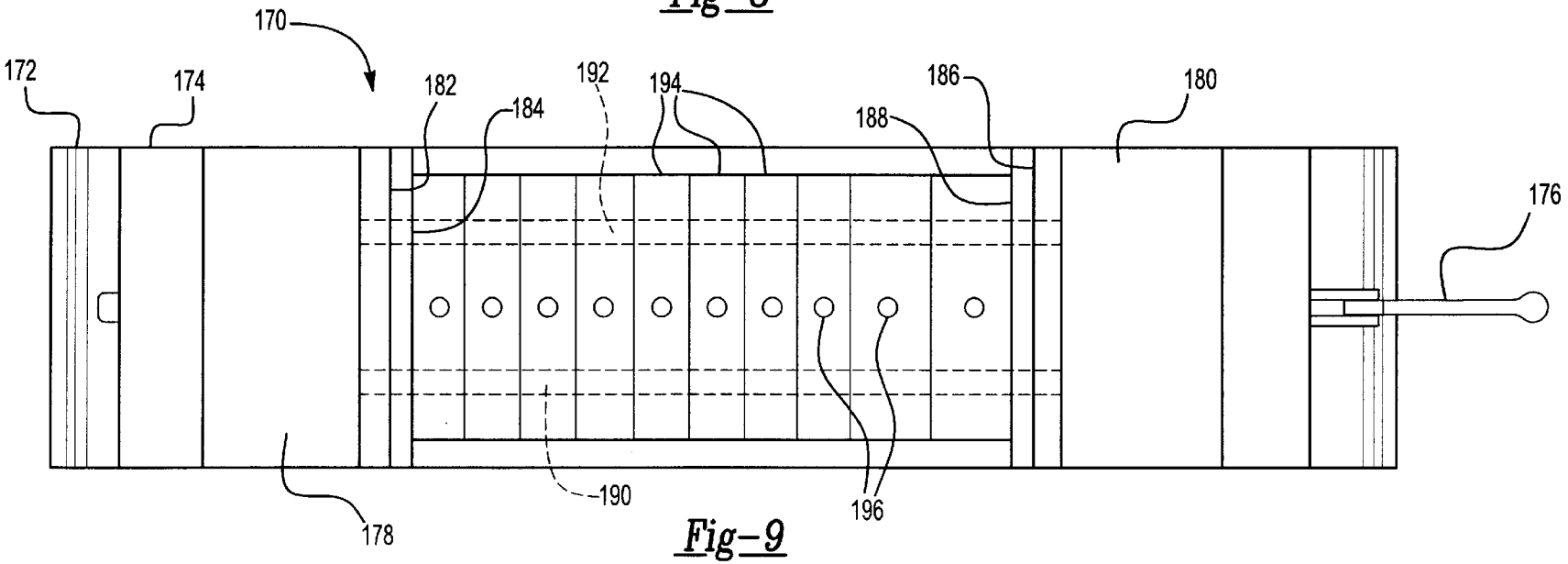
FIG. 9 is a top view of the vice jaw assembly illustrated in FIG. 8 and showing the ability to drill apertures through the workpieces without impacting the mounting pins or platform.

Referring to FIGS. 8 and 9, top and side views are illustrated, respectively, of a vice jaw assembly 170 according to a further preferred embodiment. The vice jaw assembly 170 again includes a platform 172 and a base 174. A crank mechanism 176 actuates a selected one (or both) of a first jaw member 178 and a second jaw member 180 in directions towards and away from each other. As with the earlier preferred embodiments, the first jaw member 178 includes a block portion with a workpiece engaging surface designated at 182 and, potentially, with a further workpiece engaging surface illustrated at 184. The second jaw member 180 likewise includes first and second workpiece engaging surfaces 186 and 188. First and second mounting pins are illustrated at 190 and 192 and extend between the first and second jaw members 178 and 180.

The advantage of the vice jaw assembly 170 is that it permits a plurality of workpieces 194 to be fixedly secured between the jaw members 178 and 180 and settable upon the pin members 190 and 192 such that, as illustrated by the machining operation, a series of individual holes 196 may be drilled through the workpieces 194 without damage to either the pins 190 and 192 or the underlying platform body 174 of the jaw assembly. The assembly illustrated at 170 may also include at least one or more floating spacer blocks 198 as previously described if it is desirable to secure workpieces in a more secure manner.

Figure 10:
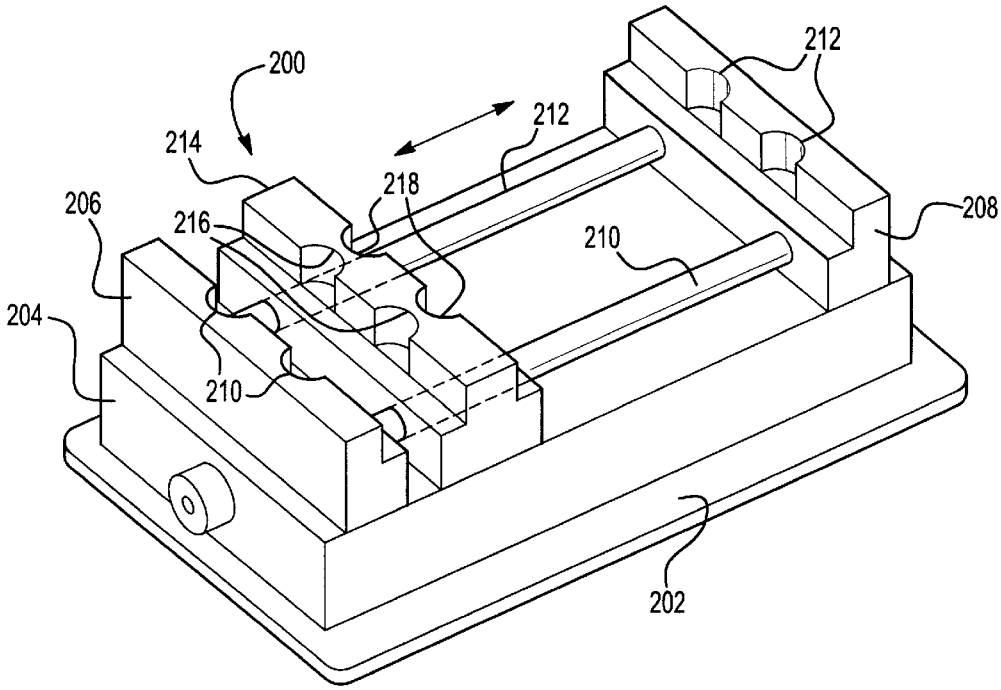
FIG. 10 is a perspective view of a yet further variation of a vice jaw assembly according to the present invention and in which the workpiece gripping surfaces of the floating spacer blocks are shaped as semi-cylindrical recesses in order to permit likewise cylindrical shaped workpieces to be secured therebetween.

Finally, with reference to FIG. 10, a further vice jaw assembly is shown at 200 and includes a base 202 upon which is mounted a body 204, a first jaw member 206 and a second movable jaw member 208. First and second mounting pins 210 and 212 are provided and extend between the first and second jaw members 206 and 208.

The jaw members 206 and 208 illustrate semicylindrical shaped portions, at 210 and 212 respectively, as a part of the workpiece gripping surfaces. These portions 210 and 212 are formed within the otherwise planar and linear workpiece surfaces which are formed along the opposing faces of the first and second jaw members. A floating jaw member is shown at 214 which is capable of being mounted between the first and second jaw members 206 and 208 by the pin members 210 and 212. Additional semicylindrical shaped gripping surfaces are illustrated, at 216 and 218, on opposite facing sides of the floating jaw member 214 and so that, upon appropriate axial positioning of the first and second jaw members, are capable of holding therebetween a plurality of cylindrical shaped workpieces 220 as shown in FIG. 11.

Figure 11:
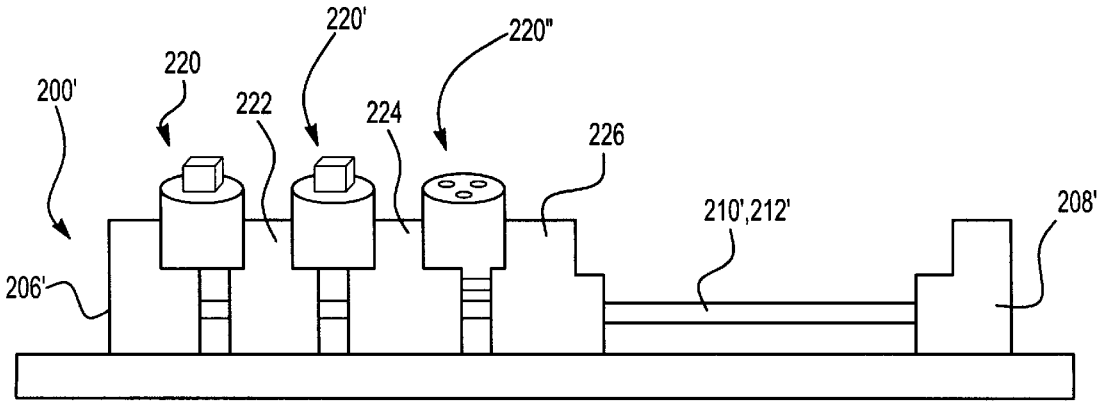
FIG. 11 is a side view of the vice jaw assembly illustrated in FIG. 10 and further showing the ability of reversing the workpieces from first to second positions in order to perform a second machining operation on an underside of each of the workpieces.

A variation of the vice jaw assembly is shown at 200' in FIG. 11 and includes first and second opposing jaw members 206' and 208' with first and second mounting pins 210' and 212'. Rather than a single floating spacer block as illustrated in FIG. 10, first 222, second 224 and third 226 floating spacer blocks are mounted at spaced locations between the opposing jaw members 206' and 208'. The advantage of the vice jaw assembly 200' is that it permits the generally cylindrically shaped workpieces, shown at 220 and 220', to be machined in a first position, and in a second or reversed position, such as is illustrated at 220".

Having disclosed my invention, it is evident that it discloses a novel and improved vice jaw assembly utilizing any number of intermediate and floating spacer blocks, from one to several, for holding a desired plurality of individual workpieces for a continuous machining operation. Additional preferred embodiments will become apparent to those skilled in the art to which it pertains without deviating from the scope of the appended claims.

I claim:

1. A vice jaw assembly mounted upon a precision machining piece of equipment, the equipment including a platform accessible by a machining tool, said assembly being capable of securing a plurality of individual workpieces during a continuous machining operation by the machining tool and comprising:

a substantially rectangular shaped and three dimensional base which is fixedly secured upon the platform;

a first jaw member and a second jaw member, said first jaw member being secured upon said base at a first end thereof and said second jaw member being secured upon said base at a second end thereof so that said first and second jaw members define opposingly arrayed faces;

means for actuating at least one of said first and second jaw members in directions towards and away from one another;

a first spacer block fixedly secured to said opposing face of said first jaw member and a second spacer block fixedly secured to said opposing face of said second jaw member, each of said first and second spacer blocks further including at least one workpiece engaging surface defined therein;

at least one mounting pin being secured at a first end to said first spacer block and extending so as to pass through an aperture defined in said second spacer block; and at least one intermediate and floating spacer block including an aperture formed therethrough and through which said mounting pin extends so that said floating spacer block is arrayed at a predetermined spaced distance between said first and second spacer blocks, said at least one floating spacer block further including additional workpiece engaging surfaces so that at least one workpiece may be secured between a selected one of said floating spacer blocks and said first spacer block and so that at least one additional workpiece may be secured between one or more additional selected floating spacer blocks and said second spacer block.

2. The vice jaw assembly according to claim 1, further comprising first and second intermediate and floating spacer blocks being arrayed between said first and second spacer blocks.

3. The vice jaw assembly according to claim 1, further comprising first, second and third intermediate and floating spacer blocks being arrayed between said first and second spacer blocks.

4. The vice jaw assembly according to claim 1, said workpiece engaging surfaces each further comprising an inwardly stepped shoulder defined within a selected top edge of said spacer blocks and said floating spacer blocks, corresponding outwardly facing edges of each workpiece being engaged between selected opposing engaging surfaces.

5. The vice jaw assembly according to claim 1, said workpiece engaging surfaces each further comprising semicylindrical shaped recesses defined within a selected edge of said spacer blocks and said floating spacer blocks, corresponding outwardly facing edges of each workpiece being engaged between selected opposing engaging surfaces.

6. The vice jaw assembly according to claim 1, said first and second spacer blocks each further comprising a pair of fastener apertures defined therethrough which align with additional apertures formed in said opposingly arrayed faces of said first and second jaw members, respectively, fasteners being engaged through said respective apertures to secure said spacer blocks to said first and second jaw members.

7. The vice jaw assembly according to claim 6, said pairs of fastener apertures formed through each of said spacer blocks further comprising a first diameter portion extending from a first face of said selected spacer block which is in contact with said opposingly arrayed face of said selected jaw member and to a selected intermediate location within said spacer block, a second enlarged and countersunk diameter portion extending from said intermediate location to a second face of said spacer block, said fasteners further including bolts with enlarged bolt heads for securing said spacer blocks to said selected first and second jaw members.

8. The vice jaw assembly according to claim 1, said at least one mounting pin further comprising a first mounting pin secured to said first spacer block at a first location and a second mounting pin secured to said first spacer block at a second offset location so that said first and second mounting pins extend in parallel fashion, said second spacer blocks and intermediate floating spacer blocks each further including aligning apertures for receiving therethrough said first and second mounting pins.

9. The vice jaw assembly according to claim 1, further comprising a crank mechanism for actuating said at least one first and second jaw members and said secured first and second spacer blocks.

10. A combination vice jaw assembly and precision machining piece of equipment, comprising:

said piece of equipment including a platform accessible by a machining tool;

said vice jaw assembly including a substantially rectangular shaped and three dimensional base which is fixedly secured upon the platform;

a first jaw member and a second jaw member, said first jaw member being secured upon said base at a first end thereof and said second jaw member being secured upon said base at a second end thereof so that said first and second jaw members define opposingly arrayed faces;

a hand crank assembly for actuating at said second jaw member in directions towards and away from said first jaw member;

a first spacer block fixedly secured to said opposing face of said first jaw member and a second spacer block fixedly secured to said opposing face of said second jaw member, each of said first and second spacer blocks further including a workpiece engaging surface defined therein and which is characterized by an inwardly stepped shoulder defined within a selected top edge of said respective spacer blocks;

a mounting pin being secured at a first end to said first spacer block and extending so as to pass through an aperture defined in said second spacer block; and a plurality of intermediate and floating spacer blocks each including an aperture formed therethrough and through which said mounting pin extends so that said floating spacer blocks are arrayed at predetermined spaced distances between said first and second spacer blocks, said floating spacer blocks each further including additional workpiece engaging surfaces defined within oppositely facing and parallel top edges so that a plurality of individual workpieces may be secured at selected locations between said first and second spacer blocks and said floating spacer blocks.

11. A vice jaw assembly mounted upon a precision machining piece of equipment, the equipment including a platform accessible by a machining tool, said assembly being capable of securing a plurality of individual workpieces during a continuous machining operation by the machining tool and comprising:

a substantially rectangular shaped and three dimensional base which is fixedly secured upon the platform;

a first jaw member and a second jaw member and means for securing said first jaw member upon said base at a first end thereof and said second jaw member upon said base at a second end thereof so that said first and second jaw members define opposingly arrayed faces;

means for actuating at least one of said first and second jaw members in directions towards and away from one another, said means for actuating including a crank mechanism;

a first spacer block fixedly secured to said opposing face of said first jaw member and a second spacer block fixedly secured to said opposing face of said second jaw member, pairs of fastener apertures being formed through each of said spacer blocks and aligning with further apertures defined within said first and second jaw members, respectively, each of said apertures in said spacer blocks further including a first diameter portion extending from a first selected face of a spacer block in contact with a selected jaw member and to an intermediate location, a contiguous and second enlarged and countersunk diameter portion extending from said intermediate location to a second face of said spacer block, bolt fasteners with enlarged bolt heads inserting within said spacer block apertures to secure said spacer blocks to said jaw members;

at least one mounting pin being secured at a first end to said first spacer block and extending so as to pass through an aperture defined in said second spacer block; and at least one intermediate and floating spacer block including an aperture formed therethrough and through which said mounting pin extends so that said floating spacer block is arrayed at a predetermined spaced distance between said first and second spacer blocks;

workpiece engaging surfaces being defined within said jaw member mounted spacer blocks and said intermediate and floating spacer blocks, said workpiece engaging surfaces including inwardly stepped shoulders defined along selected top edges of said fixed and intermediate floating spacer blocks and suitable for engaging outwardly facing edges of each individual workpiece so that said workpieces may be secured within said vice jaw assembly.

* * * * *